United States Patent [19]

Carlmark

[11] 4,372,552

[45] Feb. 8, 1983

[54] HANG STAND FOR UNLOADING OF BACKBONE DISCS

[76] Inventor: Rolf Carlmark, Box 756, S-892 00 Domsjö, Sweden

[21] Appl. No.: 197,106

[22] PCT Filed: Jan. 24, 1980

[86] PCT No.: PCT/SE80/00021

§ 371 Date: Sep. 25, 1980

§ 102(e) Date: Sep. 25, 1980

[87] PCT Pub. No.: WO80/01540

PCT Pub. Date: Aug. 7, 1980

[30] Foreign Application Priority Data

Jan. 26, 1979 [SE] Sweden ..... 7900723

[51] Int. Cl.[3] ..... A63B 23/02; A61H 1/02

[52] U.S. Cl. ..... 272/112; 128/75

[58] Field of Search ..... 272/61–64, 272/70, 70.3, 70.4, 93, 109, 112, 117, 134–144; 128/25 R, 75

[56] References Cited

U.S. PATENT DOCUMENTS

| | | | |
|---|---|---|---|
| 1,703,104 | 2/1929 | Hassler | 272/117 |
| 1,902,995 | 3/1933 | Flynn | 272/103 X |
| 3,353,532 | 11/1967 | Ellis | 128/75 |
| 3,521,881 | 7/1970 | Schaevitz | 272/62 X |
| 3,896,798 | 7/1975 | Simon | 128/75 |
| 4,113,250 | 9/1978 | Davis | 272/93 |

FOREIGN PATENT DOCUMENTS

| | | | |
|---|---|---|---|
| 940954 | 1/1974 | Canada | 272/112 |
| 1243327 | 6/1967 | Fed. Rep. of Germany | 128/75 |
| 364788 | 6/1906 | France | 128/75 |
| 194257 | 5/1967 | U.S.S.R. | 128/25 R |
| 400336 | 2/1974 | U.S.S.R. | 272/144 |

*Primary Examiner*—Richard C. Pinkham
*Assistant Examiner*—Arnold W. Kramer
*Attorney, Agent, or Firm*—Frishauf, Holtz, Goodman & Woodward

[57] ABSTRACT

A hang stand for persons with injuries to their backs, and especially for such persons who wish to unload their backs, comprises vertically arranged elongated members on a base support having an upper bar extending therebetween and located at such a height that when a person grasps the bar with both hands, the person can hang freely. Further provided is a back support slideably coupled to the elongated vertical members so as to be moveable in a vertical direction but immoveable in a horizontal direction. The back support is arranged to engage a given part of the back of the user to horizontally and immoveably support the given part of the back but permitting vertical movement of the given part of the back when the user grasps the bar and hangs freely. The back support is spring mounted and vertically adjustable. Foot supports on the base support help position the user before hanging.

8 Claims, 2 Drawing Figures

HANG STAND FOR UNLOADING OF BACKBONE DISCS

The present invention relates to a hang stand for use by a person who wishes to unload his back and open the spaces for the discs of the backbone.

Injuries to the back are frequently occuring among people in the whole world. With so-called lumbago with sharp pains in the loin back and spasmodic contraction of the back-musculature the causes thereof may be of several kinds, for instance alterations in the joints of the vertebral column or backbone and overstrain of the back-musculature.

The measures for restoring the backbone to the right position, and for bringing the musculature to work again in the right manner, may vary, as for instance physiotherapy, massage, stretch bench, etc. and direct manipulation, which is often carried out by chiropractors or the like. It has, however, appeared that in many cases of injuries to the back the so-called discs which are located between the vertebra members, have a determining influence regarding the pain incurred as well as the best manner in which the healing can be done.

In most cases, back pains, with subsequent lumbago, as described above, are due to the discs having been exposed to wrong and/or too great a load, in which cases they—in spite of the fact that they consist of cartilage and have a certain mobility—also can be compressed, so that the liquid mass existing in the core of the disc can be pressed out, with a resultant diminished ability of moderation.

In order to make the discs return as far as possible to the right position and thereby resume their ability of moderation, so that the adjacent nerves are not influenced, a separating effect must be obtained with respect to the spaces for the discs.

Known hang stands are shown for instance in French Pat. Nos. 690,032 and 862,797.

The general purpose of the hang stand according to the present invention is to rapidly help in trying to restore the co-operation between muscles, discs and vertebrae, so that back pains are reduced or eliminated.

More specifically, an object of the invention is to provide a hang stand of the general type discussed above wherein the support for the back is placed in the right position relative to the backbone and wherein this correct position is retained during the hanging.

In a hang stand of the type in question it is important that the legs can hang freely. One reason for this is that it involves an essential complication to have several points of support against the body when hanging. If several points of support against the body are used, then several widening points for the discs of the backbone are obtained. Several such widening points do not give an even and well defined widening of the spaces for the discs of the backbone but result in several and unevenly distributed widening alterations in the backbone, which widening alterations also can have a negative influence on the person hanging in the hang stand. To be absolutely sure always to obtain essentially even and, above all, over the greater part of the backbone spread widenings of the spaces for the discs, it is first of all necessary that the back support is placed in a certain fixed position for every person, and that this line support against the backbone is retained in the same position even during the hanging, i.e. the back-support always rests against the same point of the backbone.

Another reason for hanging the legs freely is that the person often wishes to amplify the widening action on the backbone letting the legs swing to and fro during hanging.

SUMMARY OF THE INVENTION

The hang stand according to the invention comprises a support for the back, which is immovable in the horizontal direction but is movably guided in the vertical direction by means of vertical tubes, the support being arranged to function as a horizontally immovable support for the intended part of the back. The hang stand further comprises foot supports which are arranged near the lower ends of the tubes and which are placed at such a vertical level above the underframe on which the hang stand rests that the person with his feet placed on the foot supports reaches a horizontal bar, and are so located that when the person grasps the bar and removes his feet from the foot supports he hangs freely.

When using the hang stand of the present invention the body of the person always will be hanging in such a manner that the loading on the backbone is reduced so that its discs are separated and can take the right position, so that the correct co-operation can be obtained between muscles, discs and vertebrae.

Thus the hang stand according to the invention is intended for serving as a hang stand with controlling or guiding ability, and also when required serves as a muscle training or strengthening device, as is described hereinbelow.

DETAILED DESCRIPTION

Figure 1:
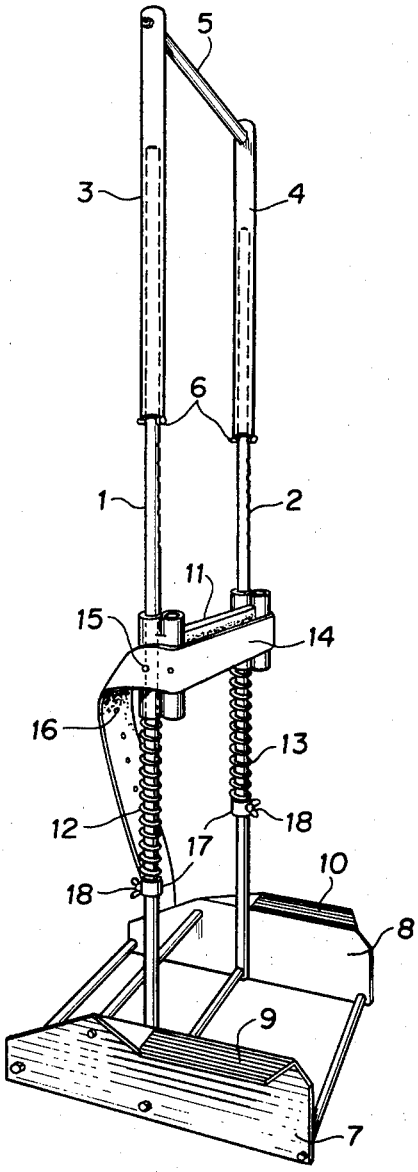
FIG. 1 as a perspective view of a hang stand according to the invention, the stand having a tube construction with an underframe.

Tubes 1 and 2 are placed vertically and serve as a carrying part for a vertically adjustable part, comprising tubes 3 and 4 and an upper horizontal bar 5. Tubes 3 and 4 enclose tubes 1 and 2 and are movable, in a telescopic manner, in relation to tubes 1 and 2. The vertically adjustable part 3, 4, 5 may suitably be adjusted vertically relative to tubes 1 and 2 with the aid of holes in tubes 1 and 2 and removable pins 6 or in some other suitable manner for vertically adjusting the height of the upper bar 5.

An underframe may for instance comprise two vertically placed, relatively high sides 7, 8 for staying the tubes 1 and 2, which sides are mutually fixed by suitable stays, which have no reference notations on the drawing. The tubes 1 and 2 are thus fixed to the sides 7, 8, respectively. In order that the person who wishes to hang in the stand shall be able to reach the upper bar 5, the sides 7, 8 are provided with bent over or otherwise arranged foot supports 9, 10 placed at the outside, the placing of which provides a free space between the sides 7, 8 for the legs and feet, when the person is hanging in accordance with FIG. 2.

In order that the body shall hang right and the best effect shall be obtained, the device further comprises a support 11 for the back, which support is vertically adjustable. The support 11 may be provided with a plurality of fixed, and in relation to the body, adjustable back supports.

The vertically adjustable back support 11 can suitably be arranged movable along the tubes 1 and 2 and may be adjustable upwards and downwards along tubes 1 and 2. Compression springs 12, 13, respectively surround tubes 1 and 2 and are adjustable upwards and downwards along tubes 1 and 2. The vertical position of springs 12, 13 are determined by respective lock members 17, 18. The springs 12, 13 bear against and determine the initial position of the back support 11, as should be apparent from FIGS. 1 and 2. Springs 12, 13 are relatively weak springs.

The vertically adjustable back support 11 may in certain cases also be provided with a belt 14 with holes 16 therein for a fastening pin 15 or other suitable arrangement for the purpose of holding the body and the back support 11 in the right mutual position.

When hanging is to be done the person climbs up on the foot supports 9, 10 and places the vertically adjustable back support 11 in the correct position against the back, and when appropriate adjustment is achieved, the person fastens himself by means of the belt 14 to support 11, if desired or necessary.

Thereafter the hands of the person can grasp the upper bar 5, wherafter he gets off the foot supports 9, 10, so that the body hangs freely without support from the underframe or—if possibly necessary—with suitable, well fitted support for the feet. Thereby the backbone part is drawn and weakly pried apart, so that the load on the discs of the backbone is reduced, and so that the space for these discs increases a little. Important to note in this connection is that the support 11 for the back acts in an accompanying manner during the lengthening of the body when hanging, so that the back support always rests against the same point on the backbone. Possibly bending the knees combined with quickly letting down the legs may be done in order to further strengthen the effect of increasing the spaces for the discs.

Figure 2:
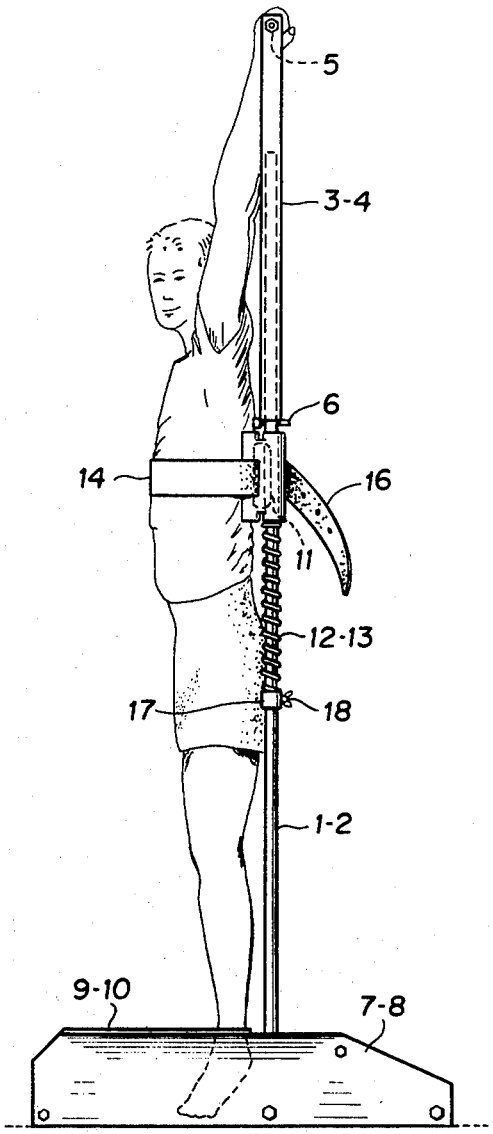
FIG. 2 shows a side view of the stand according to FIG. 1, with a person hanging in the stand.

During hanging, the hands of the person grasp the upper bar 5 with the palms of the hands directed away from the person, i.e., directed backwardly as shown in FIG. 2. This turning of the arms during hanging helps to lock the back in right hang position.

The hang stand according to the invention can be used for preventive purposes, with hanging for instance for some minutes, some day per week, in order that the body shall have a good carriage. An effect-increasing action can be obtained if the legs are brought to oscillate about the position of equilibrium to a certain degree.

The hang stand according to the invention can for instance serve as a preventive means against possible vertebra-displacements—for instance of the respiration vertebra—which can cause troubles which are difficult to diagnose because of similar symptoms which some other pathological picture also causes.

The hang stand may very well be made mountable and dismountable, so that it takes up little space for instance in transit.

The underframe may be provided with rubber feet or the like in order to protect the floor on which it is to be put.

The vertically adjustable back support 11 may also serve as a muscle developer for arm muscles and/or other muscles, in which case the springs 12 and 13 may serve as back-pressure springs. For this purpose the back support 11 may be provided with manipulation members or the like, not shown, and with springs with for this use suitable pressure strain, when necessary.

Since the device takes up so little space, a floor area of only about $80\times60$ cm$^2$ is required for the underframe. Thus, it should be possible to place the device anywhere, so that it maybe widely used, for instance in dwellings, sport fields, work shops, etc, where people simply and quickly can reach and use the device.

The invention is not limited to the design here described, but can of course be varied within the scope of the invention as defined, in the appended claims.

I claim:

1. In a hang stand for unloading the back and opening the spaces for the discs of the backbone of a person, comprising:

a pair of spaced apart, vertically arranged elongated members (1, 3; 2, 4); means (7-10) for supporting said elongated vertical members; and an upper bar (5) carried by and extending between said elongated vertical members, said upper bar (5) being located at such a vertical level that, when a person grasps said upper bar (5) with both hands, the person can hang freely;

the improvement comprising the combination of:

a back support (11) coupled to and engaged with said elongated vertical members so as to be movable downwards in a vertical direction relative to said vertical members but immovable in a horizontal direction relative to said vertical members, said back support (11) being arranged and located to engage against a given part of the back of the user to horizontally and immovably support said given part of the back but to permit vertical, downwardly directed, movement of said given part of the back along with said downward vertical movement of said back support (11) relative to said vertical members when the user grasps said upper bar (5) and hangs freely from said upper bar (5) with said given part of the back engaged against said back support (11);

adjusting means for infinitely variably adjusting the vertical position of said back support (11) in relation to said elongated vertical members, said adjusting means including infinitely movable stop means (17,18) coupled to said elongated vertical members; and springs means (12,13) coupled between said stop means (17,18) and said back support (11) to return said back support to its original location after use; and vertically raised foot support means (9,10) connected to said support means (7-10) and arranged at the lower portion of said hang stand and on which a user may step for exact location of said back support (11) and from which a user may step off to hang from said upper bar (5) freely but supported by said back support (11) and without his feet contacting the floor on which the hang stand rests.

2. Hang stand according to claim 1, wherein said spring means are weak springs (12,13) relative to the largest force applied to the springs when a person hangs from the hang stand.

3. Hang stand according to claim 1 or 2, wherein said stop means (17, 18) are located below said back support (11), and said spring means (12, 13) comprise a respective coil spring around each of said elongated vertical members.

4. Hang stand according to claim 3, wherein said back support (11) comprises engagement members slideably mounted around respective ones of said elongated vertical members.

5. Hang stand according to any one of claims 1, 2, 3 or 4, further comprising means for adjusting the height of said upper bar (5) relative to said raised foot support means.

6. Hang stand according to claim 1, wherein said support means (7-10) includes said vertically raised foot supports (9, 10) which are turned away from each other.

7. Hang stand according to claim 1, wherein said elongated vertical members are adjustable-height telescoping members for adjusting the height of said upper bar (5).

8. Hang stand according to claim 1, wherein said back support (11) comprises belt means (14) coupled thereto for encircling a body portion of the user.

* * * * *